United States Patent [19]

Manis

[11] 4,379,531

[45] Apr. 12, 1983

[54] PROJECTILE

[76] Inventor: John R. Manis, 418 Millburn Ave., Millburn Township, Essex County, N.J. 07041

[21] Appl. No.: 84,735

[22] Filed: Oct. 15, 1979

Related U.S. Application Data

[60] Division of Ser. No. 444,008, Feb. 20, 1974, Pat. No. 4,176,487, which is a continuation of Ser. No. 308,755, Nov. 22, 1972, abandoned, and a continuation of Ser. No. 90,608, Nov. 18, 1970, abandoned.

[51] Int. Cl.[3] ..... F42B 15/14

[52] U.S. Cl. ..... 244/3.23

[58] Field of Search ..... 42/76, 78; 102/92, 92.1, 102/92.2, 92.3, 92.4, 92.6, 92.7, 501, 514–517, 524; 244/3.23; 89/14 D, 14 R

[56] References Cited

U.S. PATENT DOCUMENTS 1,450,558 4/1923 Maze ..... 89/14 R 2,742,821 4/1956 Sweetman ..... 42/76 R 3,059,367 10/1962 Rosebush ..... 42/76 R 3,483,794 12/1969 Packard ..... 42/78

4,176,487 12/1979 Manis ..... 102/92

*Primary Examiner*—Charles T. Jordan

[57] ABSTRACT

A method of imparting a rotational motion to a projectile in a firearm barrel by flow of propellant gases within surfaces of the rear area of the projectile into pressure relieving chambers opening into the barrel bore along it length, each chamber allowing the propellant gases to impart an impulse to the rotational motion of the projectile, the projectile seals the bore past each chamber to prevent the escape of propellant gases so that the full volume of the gas is retained to propel the projectile until it leaves the barrel; and after the projectile has left the barrel the rear surfaces act with atmospheric air flow to increase tangential drag to reduce the effect of gyroscopic spin overstabilizing forces to provide increased range and accuracy.

8 Claims, 10 Drawing Figures

A
C
D
E
F
G
H
I
J
K
L
M
N
P
R
2
4
5
10
11
12
13
14
15
16
17
18
23
42
44
52
53
54
55

10
11
12

25
30
26
25
56

4
4
25
26
27
28
29
30
38
43
45
56
60
68
69

PROJECTILE

This is a division of application Ser. No. 444,008, filed on Feb. 20, 1974, now U.S. Pat. No. 4,176,487 which descended from continuation application Ser. No. 308,755, filed on Nov. 22, 1972, now abandoned, which descended from the original application Ser. No. 90,608, filed Nov. 18, 1970, now abandoned, and which original filing date of Nov. 18, 1970, is claimed as the filing date for this application.

My invention relates to an improvement for twisting a projectile in the smooth bore of firearm barrels of minor calibre; such as shoulder arms or hand guns, and will be described with particular reference to such use, although the principles and elements of the invention are applicable to projectiles and firearm barrels of other types; such as large calibre ordnance.

The known rifling used in firearms barrels impart a mechanical twist to a projectile while it is contained in the bore. The object of the initial twist in the bore is to create a high rate of residual kinetic spin to the projectile after it has left the muzzle of the firearm. The twisting of the projectile in free flight enables gyrodynamic force to ballistically stabilize the projectile's trajectory in order that the projectile may be accurately aimed at a given target. Although the rifling as used obtains the objective of gyrodynamic force in a projectile in free flight; there are many unwanted effects on the projectile and on the weapon used to fire the projectile when using the rifling to obtain the twist; such as, excessive amount of gunpowder gas pressure built up to push the projectile through the lands of the rifling, heavy recoil, a great amount of friction on the projectile and bore surfaces, deformation of the streamlined surface of the projectile due to the lands indentations and precession of the projectile while in free flight.

From the standpoint of interior ballistics, it is desirable for a firearm barrel to have a bore which is as free as possible of obstructions and offers as little restriction of the forward passage of a projectile as is possible, while functioning to contain the full volume of high pressure gas behind the projectile and to impart a twist, whereby friction is reduced and gunpowder gas may propel the projectile to the greatest advantage. Therefore a high muzzle velocity of the projectile may be obtained with lower developed pressures.

From the standpoint of exterior ballistics, it is desirable to have a projectile which is not deformed by the bore and which affords a streamlined free flight structure at increased velocities. Without obstructions in the bore, less gas pressure is required on the rear of the projectile at the muzzle, and muzzle blast is reduced, whereby relative recoil and tipping of the projectile when exiting from the muzzle is also reduced. Accordinly muzzle blast has little effect on a streamlined bullet surface and conversely may have a negative effect on a bullet surface which is imprinted with rifling grooves onto which a reverse twisting pressure in part may be imparted to the projectile by the muzzle blast, and thus precession of the projectile in the first stages of free flight by adverse side forces acting upon it are accordingly less.

The object of the present invention therefore is to overcome the aforesaid and other objections of the firearms of the character referred to; whereby they may conform to the requirements of interior and exterior ballistics. As a consequence, higher muzzle velocities may be obtained with the same chamber pressure now employed in, known weapons, or conversely the same muzzle velocity may be obtained with lower developed pressures.

A particular object is to provide a twist to projectiles in the smooth calibre bore of firearm barrels, which provide little resistance of passage of a projectile therethrough.

More specifically the invention consists of a helicoidal projectile to which a twist is imparted in a firearm barrel having a smooth calibre bore bearing surface. The bore also having a plurality of pockets preferably annularly formed in the walls, which define widened areas of the bore. The annular pockets uniformly segment the bore a distance from the breech chamber and along the bores remaining length; providing gas pressure relief chambers for gases contained at the rear of projectiles used in the firearm.

Or the barrel's bore might have pockets formed laterally independent and directly offset one another on two opposite sides of the bore's wall.

The invention provides a method of imparting a rotational motion to a helicoidal projectile in a firearm barrel having a smooth main bore by flow of propellant gases within the surface of a rear helicoid area of the projectile and increasing its forward velocity when fired along the main bore in which the projectile acts as an obturator wherein propellant gases under static pressure in the main bore and acting on the rear area of the projectile are subjected to a partial sudden limited relief of static pressure, into a relatively low pressure and temperature captive environment of a pressure relieving expansion chamber opening into the main bore wall forwardly of the point of maximum gas pressure, at the instant when the bearing surface of the projectile has initially passed the chamber opening in the main bore wall, whereupon the transiently accelerated bore gases are turned by the projectile's helicoidally constructed area to which said bore gases give up some of the momentum absorbed from the column of high pressure gases in the main bore to thereby effect rotation of the projectile and increase its forward velocity, the gases in said captive environment thereafter turbulently receding rearwardly of the projectile to become a part again of the column of gases in the main bore and the residual energy of the gases in said captive environment not absorbed by the projectile or barrel becoming a part of the total energy in the column of gases in the main bore, the method including the steps of repeating said partial sudden limited relief of column static pressure into subsequent expansion chambers to thereby recycle said residual energy which, together with the energy of the column of gases, causes transitory increases in projectile rotation and forward velocity by converting more of the static pressure of the gases in the column into dynamic pressure at the projectile which thereby absorbs and stores kinetic energy from the column of gases while in the barrel for free flight purposes.

Projectiles preferred for use in the firearm are formed with a cylindric body area which fills the calibre of the smooth bore and seals the opening of the pockets. Said projectiles have convergent helicoidal notches in their rearward end areas which rise to the surface of the projectile calibre; the cylindric forward end areas of the projectiles remains clear of the said notches for sealing of propellant gas in the bore.

When a cartridge is primed in the breech of a firearm barrel the gunpowder within the cartridge explodes generating gas pressure which propels the projectile forward. Said generated gas pressure fills the projectile's rear helicoidal notches; further gas pressure past the helicoidal notches is prevented by the calibre proper of the projectile's cylindric area directly ahead of the said helicoidal notches creating a seal against the smooth calibre bore walls. However as the helicoidal notches pass the edges of the smooth calibre bore and pocket wall junctions gas pressure is instantly released into the low pressure air chambers provided by the said pockets, whereby a twist is imparted to the projectile by the tangential forces of jet and turbinal propellant gas flow expanding through the projectile's helicoidal notches and impinging on their forward areas and into said bore pockets. Accordingly, a twist is created by the modulation of the forces and pressures of the propellant gas which also propels the projectile forward, said twist taking place without the loss of said propellant gas pressure past the forward end of the projectile or significantly to the free outside atmosphere while it is contained in the bore.

In the first embodiment of the firearm barrel, the twist is provided intermittently by pulsating modulation of propellant gas pressure instantly expanding out of and against all helical notches which cover the tapered heel of a projectile cooperating with a series of annular pockets which relieve gas pressure in segmented areas of the smooth bore.

In the second embodiment of the firearm, the modulation of expanding propellant gas pressure to twisting force is provided more constantly by helical notches which extend and end with a near fully tangent curve on the cylindrical calibre of a projectile cooperating with a series of lateral pockets. In this embodiment the gas flow alternates first through one side and then the other of the projectile's helicals, with the combined alternates of flow occurring ideally constantly. Either helical type of projectile may be interchangably used in either of the embodiments of the firearm barrels, provided of course they are of the proper calibre and powder case.

The projectiles of this invention, when used for very high initial velocity may be provided with an interiorly stored lubricant which protects against the build up of frictional forces between the projectile and bore surfaces. The lubricant has an affordable flow rate through small apertures located in the surface of the projectile and lubricates the entire surface of its cylindric calibre proper.

To these and other ends, the invention consists of the construction, arrangements and combination of elements described hereafter and pointed out in the claims forming a part of the specifications.

Practical embodiments of the invention are illustrated in the accompanying drawings, whereby:

Figure 1:
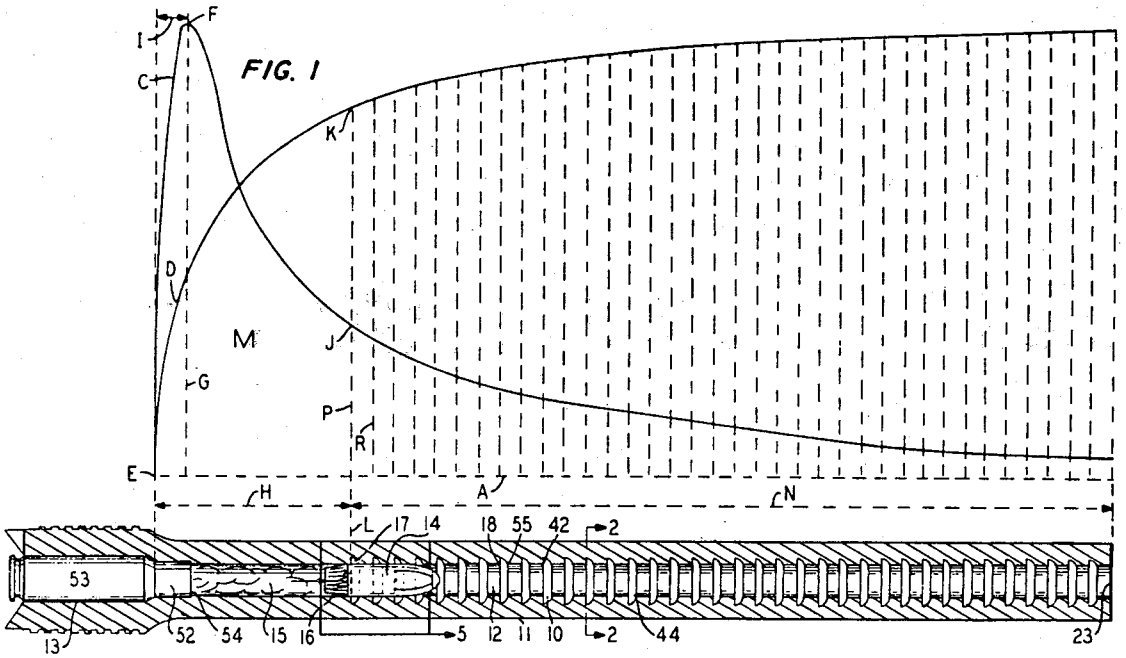
FIG. 1 is a sectional view of the firearm barrel illustrating the fired projectile just before initiating its rotational movement after its transitional movement from the cartridge case; included is a diagrammatic view for approximately representing certain features with relation to the usual gas-pressure and projectile-velocity curves or diagram.

Hereinafter the annular pockets in the bore of the firearm barrel of FIG. 1 will be referred to as annular grooves, and the lateral pockets in the bore of the firearm barrel of FIG. 3 will be referred to simply as pockets, or bore pockets. Further both the annular grooves and pockets will at times be referred to as the gas-relief chambers in reference to one or both embodiments of the firearm barrels.

There are two main classes or types of projectiles that are widely used in minor calibre arms relative to the gas pressure of the propellant that drives them through the bore of a portable firearm, namely they are termed boat-tail or sometimes called taper-tail bullets, which do not readily upset when fired through the bore of a firearm barrel and are the preferred class to be used in the firearm barrels of this invention, as shown in the drawings. The other class are termed flat-base bullets which usually do upset in the bore. One and/or the other class of bullets may be interchangeably used in either firearm barrel of FIGS. 1 and 3. If the barrels of both embodiments are to be used for both classes of bullets the bore annular grooves 10, of FIG. 1 and bore pockets of FIG. 3 should be formed far enough ahead of the breech to provide a margin of safety past the point of potential upset of the flat-base class of bullets according to the maximum pressure for which the breech is constructed, although it may be preferable to have a barrel and a particular cartridge designed exclusively for use with one or the other class of bullets just described. It will be seen by the following description of the potential upsetting effect of gas pressure on a flat-base projectile that it is essential that the pressure be adequately reduced behind the projectile as well as the character of the gunpowder changed sufficiently enough to a gaseous state in order to work properly at the bore gas-relief chambers to efficiently twist a helicoid projectile thereat. However in most instances the point in the barrels bore where it has been determined that the gunpowder has substantially changed to gas for efficiently twisting a flat-base helicoid projectile, the relative drop in gas pressure at this same point usually is sufficient and projectile upset will not occur with a flat-base projectile of adequate hardness as hereafter described.

When the projectile is fired initially from the neck of the cartridge case (into which it was seated originally by known assembly, having the projectile preferably helicals positioned within the neck) in the firearms breech a high amount of powder gas pressure is generated in the breech and to the rear of the projectile for a given distance that the said projectile travels in the bore ahead of the breech, at which indicated distance the gas pressure has dropped sharply and the powder charge has changed substancially to a gaseous state. The high gas pressure generated against the rear of the projectile for a distance just described above tends to cause the metal structure of the flat-base projectile to upset into any recesses that may be located in the bore in this area other than the true projectile calibre sized bore. For this reason the bore is not grooved with gas-relief chambers but left with a smooth solid wall in this area in order to give full support to the projectile's cylindrical metal structure of the calibre proper. The immediate area of very high gas pressure in the bore from said breech capable of upsetting a flat-base projectile would accordingly be determined by the hardness of form, calibre and weight of the projectile and by the type of gunpowder used to propel the projectile forward. Very fast or quick-burning gunpowders will generate most of their explosive power within a short distance from the breech into the bore and would have an upsetting effect on the projectile for a given distance in the bore shorter than those gunpowders which are designed to be progressive-burning or comparably slower burning. The progressive-burning powders have an extended explosive burning rate which cause high expansion and pressure of their explosive gas for a longer period of time and distance in the bore ahead of the breech, therefore upsetting of the projectile would occur further in the bore from the breech with a progressive-burning gunpowder than with the quick-burning type.

After the projectile has past the point of potential upset in the bore, the surface pressure requirement of the projectile on the remaining bore past this point of potential flat-base projectile upset is only minimal for directional guidance of its intended free flight trajectory and containment and sealing of the powder gas behind the said projectile and in its helical notches.

Figure 2:
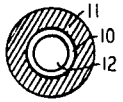
FIG. 2 is a sectional view on the respective line 2, 2 of FIG. 1.

The firearm barrel 11 of FIG. 1 shows a segmented calibre bore 12 in which a plurality of annular grooves 10 open at the surface of the smooth calibre bore walls, as shown more clearly in FIG. 2, which is a section along line 2, 2 of FIG. 1. Said annular grooves 10 begins a distance from the breech 13 and are substantially identical in form and evenly spaced in the remainder of the bores longitudinal length forward to the muzzle end. Immediately forward of the conventionally designed breech 13 is a somewhat longer projectile calibre sized cylindric smooth bore area 15 preferably with solid walls and without annular grooves 10, said smooth bore area 15 defining substantially the constant transverse dimensions of the segmented calibre bores 12 between annular grooves 10. The said smooth bore area and segmented bores are the same diameter as the cylindric dimensions of the projectile 14 calibre, or may be minutely smaller to ensure a gas seal at the projectile. In FIG. 1, as the projectile 14 enters the annular grooved and segmented bore area, here illustrated, the gunpowder propellant has been substantially changed to a fully gaseous state and reduced in pressure behind the projectile, as it passes through a plurality of annular grooves 10, the annular grooves extend a circumferencial opening around the projectile's cylindric calibre providing gas-relief chambers of low pressure and heat for the turbinal jet-stream of expanding gases coming out of the projectile's helical notches 16 at an increase in velocity and a drop in pressure and temperature from the high pressure and temperature gas contained behind the projectile, described further below.

As the helical notches 16 of the projectile 14 reach a bore annular groove 10 the helical notches 16 are instantly relieved, in part, of the high back pressure and heat of the explosive gases they contain, said gases having been sealed into the said helical notches temporarily by the confining close fit of the bore wall segment 12 to the projectile's 14 cylindric surface and also sealing lubricant between said bore segment and projectile surfaces. The instant release of highly expanding gas pressure turbinally into said annular grooves 10 allows a combined transitory amount of turbine and jet action force effects to take place through the helical notches 16 of the projectile 14 as the annular grooves 10 fill with expanding relatively low pressure propellant gas to a high equal pressure as contained to the rear of the projectile. The accumulative jet and turbinal reactionary effects of expanding gas on the helical notches 16 reacting at and in each succeeding annular groove 10 as the said projectile courses through the barrel 11 of the firearm creates a rotational motion to the projectiles, forward motion until finally increasing the rotation of the projectile to a desired rate of spin as it leaves the muzzle of the barrel, consequentially the obtained gyrodynamical force produced from the spin action ballistically stabilizes the projectiles trajectory in free flight so that it may be accurately aimed at a given target. The desired amount of spin in free flight imparted to a projectile by a particular firearm is accordingly determined by the size, spacing and number of annular grooves 10 in the segmented bore; and/or the size, number and curve of the helical notches 16 located on the projectile's body 14,—relative to the form, calibre and weight at a given velocity to which the projectile is driven by the propellant gas. The annular grooves 10 are so spaced to allow the twisting force by propellant gas expansion through the helical notches 16 to take place without the loss of the propellant gas past the forward end of the projectile 14 because of the gas sealing action of each segmented bore 12 area between the annular grooves 10, which intermittently open and close the said projectiles helicals against the gases. Hence a twisting force is applied to the projectile by the same but modulated expansive force of gas pressure and volume which is used to propel the projectile forward and without the loss of the expansive gas volume past the projectiles forward end except for possibly Young-gas, while it is contained in the firearm barrel 11, and which twisting process creates little or no additional friction to the bearing surface of projectile or bore of the firearm barrel, whereby the life of the barrel is prolonged and deleterious effects to the streamlined surface of the projectile 14 are avoided, and also thereby interior and exterior ballistic coefficients of the projectile 14 are improved.

For more fully indicating the foregoing explanation, I have shown also in FIG. 1, a gas-pressure and projectile-velocity diagram M, drawn in a known manner with the base-line A thereof alongside of the firearm barrel 11. In this diagram, the pressure and velocity curves C and D are of a form representing results such as commonly obtained in some military firearms. Beginning at the point E of the initial pressure, the line E then rises rapidly to the point, as F of the maximum pressure which is normal to the barrel. By this term, of course, is meant that the line, as G, to which the projectile will have gone forward, when the projectile is propelled by a maximum charge normally used in the ammunition for the use of which the breech 13 is constructed. In practice, this portion of forward movement of the projectile will extend forwardly at least as far as a line of maximum pressure,—as F, and preferably at least to said line when the barrel is used for the largest powder charges proper therefore. Thus the smooth bore zone, as H, may usually have a length which is somewhat greater than that of the rising pressure zone I, so that,—as herein explained,—the modulation of gas pressure through the projectiles helicals 16 into the first annular groove 17 will be delayed and so will not occur until after burning of the remaining gunpowder to a substantially gaseous state and the gas pressure has begun to reduce; this feature or point of action, is indicated in an evident manner by descending part J of said pressure curve C relative to the ascending part K of the velocity curve D at the line L. The position where the smooth bore 15 meets the first annular groove 17 may be designated as the gunpowder to gas zone H, and actual modulation of the forces and pressures of the propellant gas through the projectile's helicals 16 begin as of line L.

It is pointed out here and explained in detail in later paragraphs that zone H may also be in some instances designated as potential projectile upset zone, in that certain projectiles of the flat-base class would potentially upset (expand) in some area within this zone (however potential upset would end before the projectile reaches line L) due to the extreme pressure pushing against the rear of the projectile. However boat-tail or taper-tail class of projectiles do not upset in this zone H, or anywhere in the firearm barrels 11 bore due to their construction and will be described in detail in later paragraphs.

It is apparent by the rapid rise of the initial pressure curve C shown peaking at point F in diagram M that the powder used in this instance was of the quick-burning class and is the class of gunpowders preferably used in the firearm barrel of this invention, in that the projectile has little resistance to the initial explosive pressure of the powder gas due to the smooth bore construction. It is well known by those versed in the art of small arms interior ballistics that smokeless gunpowders must be confined in order to explode and burn efficiently and the more it is confined the more pronounced the force of the explosion becomes. It is also well known that slow burning or progressive burning class of powders require a greater confinement, and in that a preferred projectile for use with the invention (especially of the boat-tail class) provides little confinement of the powder charge of the cartridge other than the standing inertia of its gravity and the relatively small frictional resistance of the smooth bore construction of the barrel illustrated as compared to the much greater obstruction provided by a rifled bore and therefore the quick-burning class of powders is preferred.

It also may be seen that due to the thinner web and grain size of the quick-burning powders and the said quickness with which they burn into a gas state, that the zone H of the barrel may be of shorter construction and provide an early modulation of the powder gas at a bore gas-relief chamber, as compared to the length of the zone H needed if a progressive-burning class of powders were used. In practice the minimum length of zone H in a shoulder arm may be regarded as equal to six times the diameter of the bore 15, while a normal and preferable range thereof may be between six and thirty diameters or calibres, according to the size and length of the bore, the desired twist of the projectile, and the character and power of the cartridges to be used; all these matters or factors are readily ascertainable by trial in any particular instance.

To exemplify, as when a hand-gun type of firearm is used having a very short barrel and using a very fast burning powder. The burning rate of these powders being sufficiently fast for most of the powder to be changed to gas within only a fraction of an inch from the breech. If in this instance a boat-tail or taper-tail projectile is used which is the type that does not upset in the bore, then the preventive factors of projectile upset and unburned gunpowder having been eliminated, will allow the forming of bore gas-relief chambers very close to the breech.

Figure 6:
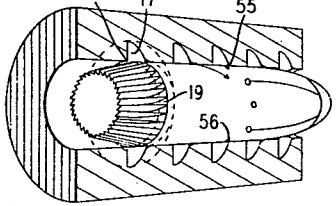
FIG. 6 is a view analogous to that of FIG. 5, illustrating the projectile in a moved position within the firearm barrel.
Figure 5:
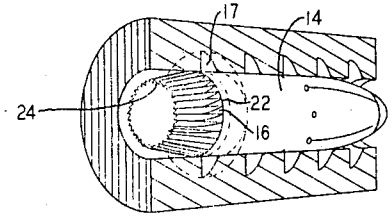
FIG. 5 is a perspective view of the projectile within the firearm barrel, which is in perspective section on the respective line 5 of FIG. 1, with a superimposed bore pocket encircling the projectile to more clearly illustrate the same.

In FIG. 1, it can be readily seen that gas modulation begins to initially twist the projectile 14 when the forward end of the projectile's helicals 16 open at the first bore annular groove 17 at line L, and shown clearly in perspective section in FIG. 5 on the respective line 5 of FIG. 1, and also shown in FIG. 6 entering the first annular groove 17. It also can be seen that succeeding lines within the gas modulation zone, as N, modulates gas pressure at substantially identical distances at each succeeding bore annular groove; all annular grooves 10 are preferably of the same form and size. The line L indicates where the initial and greatest gas modulation occurs in reference to the potential expansion and velocity of the gas at point J of the descending part of pressure curve C and at point K of the ascending velocity curve D at which points the respective curves have reached a substantial part of their values, in that the greatest rise and fall of the gas pressure has occurred relative to the greatest acceleration of the projectile within zone H. After points K and J the remaining pressure and velocity curves within zone N can be seen to have a less marked descent and ascent to the muzzle end. Therefore the pressure and velocity curves indicate that the projectile will enter each annular groove 10 with a propellant gas drop in pressure and at increased projectile velocity, both occurring at gradual rates. (It is noted here that whereas the actual potential total gas volume of the gun powder and not the speed of the gases in the bore behind the projectile is the factor that causes the projectiles final transitional velocity at the muzzle,—and in that the full volume of gas is conserved behind the projectile in this invention,—the full potential volume of the powder charge and its gases remain to impart the forward movement,—while at the same instant after an initial delay imparts the rotational movement by the modulated gain and loss in propellant gas velocity and pressure,—the full volume of the gas still remains;—as when rifling is used to impart the twist). This may be at first construed to mean that with less gas pressure and time spent by the projectile at succeeding annular grooves of the bore that twisting efficiency of the helicals 16 of the projectile 14 cooperating with the annular grooves 10 of the bore will be less. However this is true only in part, as other factors help to overcome the construed inefficiency as pointed out here and clearly shown by illustration in FIG. 6, that the position of the projectile's helicals 16 in the first annular groove 17 have entered and opened past the bore and annular groove wall junction 18 to a point at the gas-relief chamber where gas expansion against the projectile's exposed helicals 16 has ceased and the annular groove 17 has become filled with an equal gas pressure as contained in the bore behind the projectile. As can be seen, the opening of the annular groove 17 is not completely penetrated with the helicals 16 of the heel of the projectile 14 completely across it by the time gas expansion has terminated through the forward end slope of the helical curve. This amount of working penetration of the helicals 17 within the first bore annular groove 17 may be even less by the time the twisting force of the expanded gas pressure is no longer available to the said helicals but is shown exaggerated for sake of illustration. It is seen by the pressure and velocity curves C and D of diagram M that less pressure will be available for twisting the projectile 14 by expanding gas force at succeeding annular grooves within zone N. It also can be seen at the same time or instant that at each succeeding bore annular groove more of the helical sloping curve of the projectile's heel notches 14 open wider and penetrate more deeply across the opening of the said annular grooves due to the projectile's increasing velocity before gas expansion has time to terminate and therefore a greater amount of flow of the expanding gas velocity will be turned from its initial direction to give up more of its energy tangentially to the increased helical surface of the projectile and thereby the twisting rate is seen to be fairly well maintained, although at a somewhat lower expansive velocity of the gas that was available to the preceding annular groove when the projectile is traveling within zone N due to the lower coefficient of gas pressure. It may also be further seen too that the resistant inertia of the projectile mass to the twisting force being considered less at each succeeding bore annular groove will also make up for some of the loss of available gas pressure expansion to the helicals and therefore a satisfactory twisting rate should be maintained to the projectile even though all bore annual grooves are of the same form and/or capacity.

In practice the bore annular grooves may be put to use in any form or spacing suitable to cooperate with a helicoid projectile so long as the gas sealing feature of the bore wall to the projectile surface is retained.

To further exemplify in the instance where a gained twist is desired, or in the instance where differing pressure and velocity curves call for a constant twist in a particular firearm, each annular groove may be gradually enlarged and their spacing may also be changed along the length of the bore to produce and contain in succession a larger quantity of expanding gas pressure available to the projectile helicals for improved overall twist potential.

In diagram M the zone H is of sufficient length to allow burning of the gunpowder in the bore from the breech to a substantial gas state, as described before, so that any remaining unburned powder grains within the gas will be at least reduced sufficiently in size so that they pass easily through and do not tend to clog the projectile helicals as the gas passes through into a gas-relief chamber of the bore.

The projectile in the barrel of FIG. 1 and shown in FIGS. 5, 6, 7, 8 and 9 are all formed with a tapered heel, this type of projectile as described in past paragraphs being known by those versed in the art of interior ballistics not to upset in the bore because of the wedging action of the gas pressure in the bore trying to pass around the said tapered heel of the projectile. Therefore the wedge action of the gas tends to compress rather than to expand or upset the projectile, although actual compression of a suitably hard jacketed projectile does not occur. Therefore the helically notched tapered heel of the projectiles do not upset from gas pressure because of the similar gas wedging form of their helicals sloping from the rearmost area and circumferencially ending at the full cylindric periphery of the projectile calibre. Thus the non-upsetting heel of the projectile is radically changed in form and serviceability of its character from the known conventional smooth conical boat-tail projectile concept. The adaptation of the said gas wedge type helicals to conform to the non-upsetting properties of the boat-tail projectile, also naturally form the helical notches into convergent type nozzles, described below, because of the gas wedging effect on them when the said helicals come into contact with the opening of an annular groove of the bore, which is clearly illustrated in FIGS. 5 and 6. In FIG. 5 a perspective cut of the barrel of FIG. 1, shows the projectile being propelled by powder gas with its helicals 16 about to enter through an annular groove 17 opening in the bore, (partially superimposed). In FIG. 6 the projectile has advanced slightly in the bore with the forward end periphery of its helically notched tapered heel passing the opening of the first annular groove 17. The opening of the convergent helical notches of the projectile is initially provided by the bore and annular groove wall junction 18 and allows propellant gas contained in the rear helical notches of the projectile to explosively expand with greatly increased velocity especially at the point of the said junction 18 opening and along the forward exposed helical slope 19 of the heel notches, which have penetrated within the said annular groove opening, whereat the expanding high velocity gases which have an initial direction along the bore's longitudinal axis are transitorily turned by the said helical notches instantly in part to the left giving up part of their kinetic energy gained at the said junction 18 to the projectile causing a tangential kinetic force to be imparted to the projectiles helical notches causing the projectile to twist somewhat to the right, as indicated. This divergent gas expansion and gained velocity forward of the said junction 18 opening is greatly influenced and helped by the convergent gas effect of the remaining tapered area of the helically notched heel of the projectile directly behind the point of the said bore and annular groove wall junction 18 opening causing a wedging of the propellent gas pressure between the converging walls of the projectiles helical notches and the main bore; further, more specifically, as the projectiles tapered heel passes by a bore and annular groove wall junction 18, the tapered heel provides an opening which widens gradually for the passage of propellant gas at the said junction 18, which said gradual opening is always smaller in size than the opening provided for the gas flow at the rearmost end of the tapered heel and therefore the entire helically notched tapered heel periphery initially acts as a convergent nozzle for the increased flow of propellant gas from the extreme rear of the projectile to the said junction 18 opening, of which is passes cooperating with the wall of a smooth bore segment. Hence while the said gas velocity is efficiently further increased divergently forward of the said opening at the junction 18 of the bore and annular groove walls to react on the forward exposed part of the projectile's helicals 16 to effect a twist, the segmented bore walls directly behind the said junction 18 opening are not subjected to the higher velocity of the gas forward of the said opening, and because of the limited volume and effect of increased velocity of convergent gas flow thereat not having time or direction enough to significantly cause undue gas-cutting (erosion) of the bore walls. Therefor the said segmented main bore walls are saved from the effects of high velocity gas cutting and/or erosion. It is further pointed out here, that the normal propellant gas pressure contained around the tapered heel area of the projectile before the said tapered heel of the projectile 14 passes and opens at a bore annular groove; is likely to undergo a rise in this normal pressure of the gas in this area each time the taper-heel helical notches 16 open at a bore and annular groove wall junction 18, due to a drop in pressure and increased gas expansion forward of the said junction 18 opening; as it is known that when gas that is under pressure is suddenly released, there is a rise in pressure at the point of release. This may be justly construed to mean that due to the said rise in propellant gas pressure in the bore at the opening of the bore and annular groove wall junction 18, that the wedging pressure of the propellent gas in this area or point of action is increased against the tapered heel of the projectile, and as a consequence the propelling efficiency of the gas pressure wedging the projectile rotatively forward at its rear taper would be improved.

Figure 8:
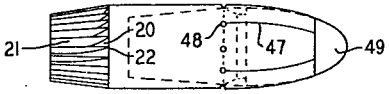
FIG. 8 is a view in side elevation of the assembled parts of the projectile of FIG. 7, superimposed.

Referring to FIG. 8, the helical notches 16 as described in past paragraphs are located on the tapered rear of the projectile 14. Here the helicoid shape is formed as a notch beginning at the rearmost end of the tapered area. The wall of the side taking the helicoid form 20 begins disposed substantially radial towards the projectiles longitudinal axis and gradually curves and rises on the constant angle of plane wall 21 of the other side of the notch, finally merging at the cylindric peripheral edge 22 of the projectile calibre. All other helical notches are substantially identical and may be formed in any number, from two opposed helical notches on opposite sides of the projectile, to as many as illustrated, which fully cover the tapered heel of the projectile. The helical notches 16 of the projectile 14 have a helical wall 20 of the notches which curves to the left and causes the projectile to twist to the right; however the helical notches if formed for either a right or left hand twist is analogous to the twisting means of the gas pressure.

The annular grooved bore cooperating with a helicoid projectile may be designated as the pulse-jet type turbinal twist means of the expanding gas in the firearm barrel of FIG. 1. To continue more specifically; as the projectile 14 passes through an annular groove 10 of the bore, the expanding gas pressure has an impulse jet and turbinal flow through the forward area of the helical notches 16 of the projectile 14 and thereat provides a tangential pressure to the projectiles cylindric mass, momentarily imparting a twisting force to the projectile at each bore annular groove 10, where said twisting force is stored as kinetic energy by the said projectile mass. Thereby the projectile 14 continues to have a residual amount of twisting motion as it moves forward, although its helical notches 16 are momentarily relieved of turbinal gas flow through them and hence twisting force is momentarily terminated as the said projectile's helical notches 16 leave an annular groove 10 and pass through the confines of a segmented bore 12 area. The original twisting force kinetically stored by the projectile 14 mass at the annular groove 10 just passed is enough to overcome the frictional forces of the segmented bore 12 wall areas between the said annular grooves 10 and thereby the projectile 14 is carried to each annular groove 10 through the said segmented smooth bore 12 areas having a continuous residual kinetic twisting motion. The twisting cycle continues until the projectile 14 leaves the muzzle 23 of the barrel 11, having closely followed a spiral path through the bore of the barrel 11; as when rifling is used to impart the twist.

The helical notches 16 located on the rear of the projectile 14 are used for gas pressure expanding through and over the rear of the projectile 14 towards its forward end, and thereby as the projectile 14 leaves the muzzle 23 of the firearm barrel 11 the expanding muzzle-blast of high velocity propellant gases, directly behind, overtake the projectile's initial muzzle velocity in free flight and continue to have a twisting effect on the projectiles rear helicals 16 for a short distance from the muzzle.

Referring to FIG. 5, the rearmost edges of the wall areas 24 of the helical notches 16 when formed as shown around the full peripheral surface of the heel, may contingently be susceptible to some bending by the initial propellant gas pressure in the cartridge case pushing the forward part of the still as yet unburned gunpowder grains with great force against the said rear part of the helical walls, however this would have no substantial deleterious effect to the twisting efficiency of the helical notches 16 of the projectile 14 as the forward sloping areas of the notches near the projectile's rear cylindric end area 22 are used primarily for twisting the projectile by gas pressure and are sufficiently strong, as the angle of pressure here has less strain on the helical walls. In the instance whereby the rearward walls 24 of the notches did bend, the bend would be as described, confined to the rearmost end of the notches walls, and most likely of an even nature around the rear periphery of the heel and therefore the balance of the projectiles mass to its center of form would not be effected. It is pointed out here, that when a preferable steel jacketed solid base taper-heel projectile is fired from the cartridge case with preferably quick-burning type thin web gunpowder, it is not expected that bending of the helical notches within the taper-heel area will occur.

The radius point of the projectile calibre where tangential velocity of the gas initiates its rotation or twist at each annular groove 10 of the bore, only rotates the said radius point of the projectile 14 a small amount between bore annular grooves 10. The twist between bore annular grooves is preferably from one sixty-fourth to one sixteenth of the projectile's calibre. By the twist between annular grooves 10 is meant the amount of rotation taken by the projectile as the forward most end of its helical notches 16 reach first one and then a succeeding bore annular groove 10; or in diagrammatic terms, the impulse twist of one sixty-fourth to one sixteenth of the projectile's calibre is seen to take place in diagram M between lines P and R and between all lines thereafter within zone N, which lines in zone N indicate the rear junction 18 of each bore and annular groove wall. The exact amount of twist being of course accordingly determined by the amount of gyrodynamic force needed to be generated by the twist in order to stabilize ballistically a given projectile for flight, relaive to its weight and form as well as its initial velocity.

Figure 4:
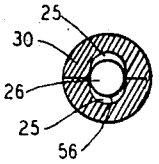
FIG. 4 is a sectional view on the respective line 4, 4 of FIG. 3.
Figure 3:
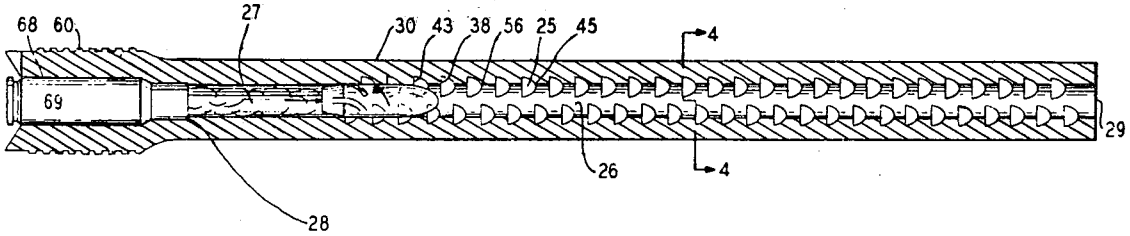
FIG. 3 is a sectional view of another embodiment of the firearm barrel and projectile, analogous to that of FIG. 1.

A second embodiment of the invention is shown in FIG. 3. In this version the bore gas-relief chambers are formed as lateral bore pockets 25 which open into less than half the bore walls 26 circumference, as shown more clearly in FIG. 4. In FIG. 3 the bore pockets 25 can be seen to be directly offset independently in relative equal positions in two sides of the bore wall. Each of the bore pockets 25 are substantially identical in form and spacing and positioned beginning from a solid smooth bore wall area 27 a distance from the breech 28 and along the remaining length of the bore towards the muzzle end 29. The said solid smooth walled bore area 27 directly ahead of the breech 28 is free of the bore pockets 25 and serves the same purpose as was described for the firearm barrel of the first embodiment. The pockets 25 placed in this manner in the bore wall, give some added support to a projectile as more clearly shown in FIG. 4, by allowing a line of bore area 26 to remain on opposite sides of the longitudinal axis of the barrel 30 and extending between offset opposite sides of the said pockets 25. The added support given a projectile by the bore is not considered as essential when the bore pockets 25 are placed starting far enough ahead of the breech 28 where gas pressure of a maximum charge is sufficiently reduced to insure against projectile upset of the flat-base class of factory produced ammunition. However in the advent of hand loaded ammunition where pressures of the ammunition may vary and inadvertently be over maximum, then the added support may be considered as a safety feature.

Figure 9:
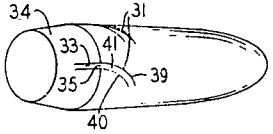
FIG. 9 is an enlarged perspective view of a helicoid projectile in the firearm barrel of FIG. 3.
Figure 10:
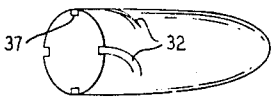
FIG. 10 is a perspective view of a projectile with an alternate embodiment respective to the projectile of FIG. 9.

FIGS. 9 and 10 show second and third types of helcoid projectiles. FIG. 9 shows a taper-heel projectile of the non-upsetting class; in this embodiment the helical notches 31 are on the cylindric sides of the projectile calibre. The taper-hell projectile is pointed out here as preferable to the flat-base class projectile also shown with similar helical notches in FIG. 10. The taper-heel projectile of FIG. 9 is also shown in the firearm barrel of FIG. 3. The flat-base projectile of the upsetting class of FIG. 10 has helical notches as just pointed out substantially the same as the taper-heel projectile's helicals of FIG. 9, the only difference is that with the taper-heel projectile a straight slot 33 is provided on its tapered heel 34 to provide a rear opening 35 for the working part or area of the helical on its cylindric sides. The slot 33 does not work in providing a twist to the projectile other than to permit propellant gas to enter the working part. The straight slot 33 of the taper-heel projectile of FIG. 9 is naturally omitted on the flat-base projectile of FIG. 10, as the flat end of this projectile provides the natural opening 37 for its helical notch 32. The taper-heel and flat-base projectiles of FIGS. 9 and 10 having helical notches 31 and 32 of substantially the same form therefore work in the same manner to provide or impart a twist to their respective projectiles and the foregoing description of the twisting characteristics of the helical notches 31 of the taper-heel projectile of FIG. 9 cooperating with the bore pockets 25 of the second embodiment of the firearm barrel 30, can be applied to the flat-base projectiles helical notches 32 of FIG. 10. The taper-heel projectile of FIG. 9 has four helical notches 31 formed identically and equally spaced around the cylindric calibre proper. The helical notched areas open and extend along the cylindric sides of the projectile's surface which are normally closed off by the bore wall 26 sized to the cylindric calibre proper of the projectile, leaving only the rearward end of the notch opened 35 to the propellant gases contained in the bore to the rear of the projectile, thereby the propellant gases may only flow through the helical notches 31 when they open at a bore and pocket wall junction 38. The straight slot 33 and the helical walls 39, 40 are formed perpendicular to the longitudinal axis of the projectile from the floor 41 of the slot and helical notch. The floor 41 is parallel with the longitudinal axis of the projectile. The upper edges of the helical notches walls 39, 40 naturally follow the curvature of the cylindric sides of the projectile until they merge with the floor 41 of the notch. Therefore it can be seen that the helical notches walls 39, 40 gradually decrease in surface area forwardly until they end merged with the floor 41, and thereat the helical notches 31 open at the junction 38 of a bore and pocket wall with an opening which recedes for the entire length of the helical notch always smaller than the opening of the notch at the rearmost end of the projectile and there through gas flow is always convergent to the ever widening forward opening, where it expands and efficiently gains velocity with the help of the convergent nozzling effect of the entire helical notch. As shown in FIG. 9 the helical notches 31 curve and end at almost a full tangent to the circle of rotation of the projectile calibre proper and thereat an initial high velocity jet-stream of expanding propellant gas issues from the said helical notch opening into a bore pocket 25 with a jet reaction force occurring in the notch at a direction which is perpendicular to the radius at that point of action in the projectile's surface and whereat a rotational movement is imparted to the projectile. As the helical notch 31 opens wider further along its curve at the bore and pocket wall junction 38 as the projectile advances through the bore, more of the curved surface area of the forward helical wall 39 is exposed to the jet-stream from the junction 38 opening which becomes less tangentially defined relative to its exit point because of the decreasing arc of the helical notch at the site of the said opening; however the direction of the expanding gas of the jet-stream is turned instantly in most part with great velocity at a more defined tangent by the increasingly exposed arc of the helical wall area 39 directly forward of the said opening of the notch which said wall 39 acts as a forward swept vane to the high speed jet-stream of expanding gas pressure at the bore pocket 25. In this way the forces of expanding propellant gas pressure are effectively modulated by the projectile helical notches 31 cooperating with the bore pockets 25, whereby tangential jet and turbinal flow force effects of the propellant gas combine to impart the twist to the helicoid projectile of FIG. 9, and in this manner or process twisting action is ideally continuously imparted to the projectile by allowing constantly alternating transient passing of the high heat and pressure of the propellant gas through alternate helical notches 31 on the sides of the projectile into the alternate positions of the offset bore pockets 25, which provide gas relief chambers of low pressure and heat for the said propellant gases as the projectile passes through the barrel 30 of the firearm.

The twisting cycle more specifically begins as the projectiles helical notches 31 past firstly a pocket 25 in one side of the bore wall 26, with gas expansion terminating through them, at the same instant helical notches 31 extending on the opposite side of the projectile are just beginning to contact and open at a directly offset bore wall and pocket junction 38 in the opposite side of the bore, whereat gas expansion is just being initiated at the said initial opening of the helical notches 31, thereby a substantially constant twisting force is imparted to the projectile. When the projectiles leave the muzzle 29 of the barrel 30 a final twisting force is imparted equally to all sides of the projectile by propellant gas escaping through all the projectile's helical notches 31 at the same instant, as the said helical notches 31 leave the confines of the bore at the muzzle 29, thereby any residual twisting kinetic side forces, still acting unequally on and caused to the projectile by the alternating twisting forces of the bore pockets, are neutralized at the muzzle 29, and the projectile leaves the said muzzle end maintaining initially a longitudinal axis with that of the bore, as it merges into its free flight trajectory.

It is seen that the projectile of FIG. 9 and in the same manner the projectile of FIG. 10 have helical notches which form convergent nozzles for the propellant gas flow as does the projectile of FIG. 8 and hence all three embodiments of the helically notched projectiles allow comparitively high velocity gas expansion to occur at the junction point of a bore wall and gas relief chamber, whereat and comparitively high velocity gas expansion will take place within a gas-relief chamber and the smooth calibre bore walls of both embodiments of the firearm barrels are saved from the effects of high velocity gas cutting and/or erosion of the bores when the said bore gas-relief chambers cooperate with the projectiles of FIGS. 8, 9 and 10 to impart a twist. Further both embodiments of the firearm barrels of FIGS. 1 and 3 show particular bore gas-relief chambers in their barrels which are alike in their respective barrels, in that both barrels show gas-relief chambers that are of equal size, form and spacing, as was described in detail for the first embodiment of the firearm barrel; the equal size, form and spacing of the bore gas-relief chambers cooperating with a helically notched projectile to impart a twist and which projectile is gaining velocity through the bore with a drop in pressure of its propellant gas, should not be construed to mean that the projectile will have substantially less twist imparted to it at each succeeding bore gas-relief chamber. As in the first embodiment of the firearm barrel, the factors described which effect the twist rate, can also be applied to the second embodiment of the firearm barrel; whereas the projectile's inertia of mass is gradually overcome at each bore gas-relief chamber and makes up in part for the gradual loss of force of the receding propellant gas pressure. Also it is visualized that some time must be consumed before an element reacts to a certain given condition or factor and although the time consumed may be in milli or micro seconds, the time is still consumed and should be accounted for, relative to the velocity factor of the projectile. Therefore it may be seen, that at the very instant of the initial opening of the helical notch at a bore and gas-relief junction, there is a certain amount of delay before gas contained in the said helical notch begins to react and flow and/or expand through the initial opening of the notch, therefore the quickness with which a projectile's helical notch opens into or at a bore and gas-relief chamber junction the greater will be the opening size of the helical notch aperture before the initial reactive flow time of the propellant gas within the helical notch begins, and therefore the initial actual volume of flow of the gas increases with the gained velocity of the projectile. (The gradual widening of the forward area of the helical notch aperture occurs as the said helical notch passes the junction of a bore and gas-relief chamber because of its convergent form). Thereby although the pressure may be less at each succeeding gas-relief chamber; so is the restrictive factor to initial flow; other factors considered, the projectile is seen to take an efficient twist at all gas-relief chambers.

The helicoid projectile just described, may interchangeably be used in either the first or second embodiments of the firearm barrel, providing of course both barrels are made for identical powder cases. If the projectile of FIG. 9, described for use in the second embodiment of the barrel, is used in the first embodiment, cooperating with the annular grooved bore version of the barrel; the twisting force imparted to its helical notches 31 will substantially be characteristic of the twisting force imparted to them with the firearm barrel of the second embodiment, the only difference being, that modulation of the propellant gases will occur within all the projectile's helical notches at each annular groove of the bore in the first embodiment.

In the second embodiment the bore pockets 25 may progressively be enlarged towards the muzzle end increasing gradually the potential volume of expanding gas pressure which may be released from the projectile helicals and thereby a gained twist may be imparted to the projectile; or a constant rate of twist may better be maintained in some particular firearms. Of course it is essential that the bore pockets remain so placed, that a bore wall area remains situated, whereby propellant gas remains sealed at and around the projectile calibre proper and does not escape past it.

Both embodiments of the walls forming the annular grooves 10 or pockets 25 of the bores of the firearm barrels of FIGS. 1 and 3, although situated and sized differently, the said walls forming the said annular grooves 10 or pockets 25 are substantially of the same form; the pockets 25 of the second embodiment simply are shorter in radius area than the annular grooves 10 of the first embodiment. Further the pockets 25 walls of the second embodiment follow an axis independent of the bores axis, as shown more clearly in FIG. 4. Thereby the opening of the pocket 25 walls at the junction 38 of the bore wall defines a curve which is formed around a separate axis; in the first embodiment, the opening of the annular grooves 10 walls at the junction 18 to the bore walls is defined circumferentially around the bores axis. The said bore annular grooves 10 and pockets 25 are both formed with their rear walls 42 and 43, perpendicular to the longitudinal axis of their respective barrels and allow free influx of the propellant gases, the front walls 44 and 45 of the annular grooves 10 and pockets 25 (as shown in FIGS. 1 and 3) curve forwardly until they merge into the surface of their respective bore walls. The plurality of annular grooves 10 and pockets 25 formed in the bores of their respective firearm barrels, work in combination with their respective bores and helicoid projectiles, to support and help acquire a twisting force to be imparted to the helicoid projectiles, by regulating and sealing the propellant gas pressure to the projectiles, so that the said gas may pass through the projectile's helical notches without leaking entirely past the projectiles themselves, as described in detail in past paragraphs. Further it is noted, that the annular grooves 10 and pockets 25 become equally pressurized with propellant gas pressure as contained at the rearmost end of the projectiles as their helical notches pass them. The said propellant gas equalization taking place before the rearmost end area of the projectiles working helical notches passes the rear junction of the bore and annular groove or pocket walls, thereby the bore walls give support to the gas action to the projectile's helicals until expanded gas pressure at them has terminated.

As shown in FIGS. 1 and 3, the bore annular grooves and pockets 10 and 25, naturally allow a substantial area of the bore walls to be relieved away from the cylindric calibre proper of the projectile's surface, thereby additionally reducing frictional drag to the projectile by the bore walls.

The bores of the firearm barrels of FIGS. 1 and 3, just described, provide little resistance or obstruction to the passage of a projectile while imparting the twist, thereby deleterious effects to the projectile or to the firearm barrel used to impart the twist are avoided, whereby accuracy and range of the projectile are improved and the life of the firearm barrel is prolonged.

The firearm barrels of this invention can be manufactured by using known expanding rifling jigs adapted for rotary cutting of the annular grooves 10, or the pockets 25, may be formed by the collapsable mandral process of firearm making. It will therefore be apparent to those skilled in the art of gunsmithing that annular grooved or pocketed bores of a firearm barrel can be practical, and readily manufactured by adaptation of known gunsmith tooling means and with no more difficulty than is experienced with known firearm barrel manufacturing.

The cleaning after use of a firearm barrel as herein described, would necessitate the use of a rotary driven type cleaning rod to replace the push-pull conventional types now in use.

Known jacketed projectiles do not normally require a fluid type lubricant and generally consist of two parts, namely a soft inner core usually made of lead or lead alloy, with a supporting jacket on the outside made of a harder gilding metal. The gilding metal usually consist of 90% copper and 10% zinc, or sometimes the jacket is made of mild steel, copper plated. Gilding metal of known jacketed projectiles has solved the problem of metal fouling of firearm barrel bores, as it does not rub off at present velocities to which said known jacketed projectiles are propelled. In some instances the gilding metal jacket is additionally provided with a cannelure or cannelures which are used to store a hardened liquid lubricant. The projectile cannelures are formed always a distance rearward from the point where the forward end ogive area merges with the cylindric area or true calibre of the projectile. The lubricant of the cannelures is used to protect the bore from rust and to reduce the frictional drag of the projectile's surface against the bore wall in order to allow its maximum initial velocity in the bore to be increased when fired there through. It is noted that a sufficiently large enough cylindric area of the calibre proper must be left on the projectile's surface forward of the lubricant cannelures and to the rear of the ogive point, in order that the neck of the cartridge case may be crimped onto the projectile ahead of the said lubricant cannelures to properly seat the projectile therein. Therefore, when the projectile is fired through the bore a forward calibre sized area of the projectile which contacts the bore wall and was previously used for crimping the cartridge case onto the projectile receives no lubricant; lubrication of this area must be relied on only by lubricant left on the bore walls by a previously fired projectile. The lubricant left on the bore walls by a proceeding projectile is very thin and partially vaporized and broken down by the hot propellant gases that propelled the proceeding projectile and usually the forward calibre sized end of the projectile's surface remains ineffectively lubricated and limits the velocity to which the projectiles may be driven, especially when fired through a known firearm barrel with high frictional forces present due to the rifling in the bore.

It may be seen by the description of the firearm barrels and projectiles in the drawings, that much higher velocities of a projectile heretofore not available with known firearms, may now be possible, and although the barrels in the drawings greatly reduce friction of a projectile as compared to a rifled bore, it is still desirable to have a projectile properly lubricated when fired at extreme velocities, as the gilding metal of the jacketed projectile, if only partially well lubricated may become sub-standard at these velocities. Further, it has been shown by others that dry or partially dry known jacketed projectiles sometimes may build up enough frictional heat from the bores surface at high velocities, where although not depositing metal of the jacket on the bore walls, enough heat is transferred through the jacket to the soft lead core which at a short distance in free flight partially liquifies and causes some inaccuracy of the projectile trajectory.

The lubricant of the projectile cannelures just described, although somewhat effectively reducing friction between the said projectile and bore surfaces of a known firearm barrel, may not effectively lubricate a helicoid projectile fired through an annular grooved or pocketed bore which provides air spaces to the surface of the projectile. In this instance the lubricated cannelures if used, whereby they open fully on the surface of the helicoid projectile, would be unconfined at times by the bore air spaces and the said stored lubricant of the projectiles cannelures may be sloughed off or have an excessive flow rate into the said bore air spaces when reacting by its inertial fluid resistance to the twisting and forward movements of the projectile gained in the bore, and therein the lubricant may flow and be expended or greatly reduced out of the projectile's cannelures before the projectile completes its full passage therethrough. Thereby the bore surfaces may not be properly lubricated against the projectile's surface, especially at the forward area of the bore.

Figure 7:
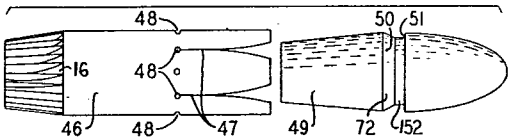
FIG. 7 is a view in side elevation of the disassembled parts of a projectile which show parts for interiorly storing lubricant.

A further objective therefrom is to have a helicoid jacketed projectile available for use in the firearm barrels of this this invention lubricated in such a manner or process, as to allow controlled flow of the said projectile lubricant, even though the cylindric surface of the said projectile containing the said lubricant is at times free from the confinement of the bore walls. Said projectile lubricant would flow at a controlled rate, such as to properly lubricate the entire cylindric surface of the calibre proper of the projectile for the length of the bore of the firearm barrel. This objective is reached by the projectile shown in FIGS. 7 and 8. (This same projectile is shown in perspective view in FIGS. 5 and 6). An unassembled view of a jacketed projectile is shown in FIG. 7. The jacket 46 which is preferably made of steel with a gilding metal coating, is provided with helical notches 16 on its tapered heel area, the heel is shown made of solid construction to retain the form of the helical notches therein against the pressure of propellant gas. The jacket is also provided with banana type splits 47 of known design in the forward end, which control the forward expansion of the projectile when it comes into contact with a target. At the rear and between said splits 47 are apertures 48 which open into the interior hollow of the jacket 46. Forward of the jacket is shown its soft metal inner pre-swaged core which is provided with a cannelure which hereafter will be referred to as lubricant trap 50, which is used to store lubricant (not shown) interiorly when the projectile is assembled, as shown in FIG. 8. The forward wall 51 of the lubricant trap 50 is perpendicular to the cores longitudinal axis from floor 152, the other wall 72 slopes rearward from floor 152 until it merges with the surface of the core 49. The core is normally positioned assembled in the hollow of jacket 46, as shown superimposed in FIG. 8. The banana splits 47 are then swaged over the lubricant trap 50, and over the forward ogive end of the core 49, locking the said core 49 permanently into jacket 46. The assembled projectile shown in FIG. 8 has aperture 48 of the jacket 46 positioned directly over the rear peripheral edge of the lubrication trap wall 72, providing openings through which the lubricant can flow. Warm, stable high viscosity lubricant under pressure is then injected through apertures 48, of the jacket 46, of the assembled projectile and into the interior lubricant trap 50, of the core 49, it being preferable that at least one jacket aperture 48 be left open and used as a lubricant weep outlet at the time of lubricant injection, in order that all air is expelled and the interior core cannelure of the lubricant trap 50 is completely filled with lubricant. Once injected the lubricant which contains wax and oils in a suitable combination cools and gains viscosity to a predetermined degree which leaves the said lubricant in a putty like state within the said projectile. (The lubricant may also be injected at a desired preset viscosity at room temperature, according to the amount of viscosity of the lubricant required in a particular projectile). Thus the lubricant cannot readily flow back out of the jacket apertures 48, and is stable enough even at the instant of injection to prevent leaking out of the said apertures 48, or by capillary action, leak out of the lubricant trap 50 and between the inner surfaces of the jacket 46 and core 49. If the inner surfaces of the jacket and core became coated with lubricant, a danger would exist whereby the said lubricated surface of the jacket and core would lose substantially their frictional surface holding forces and the jacket may be twisted loose and separate from the core when the said projectile is propelled and twisted through the firearms barrel. The said lubricant therefore flows only out of the lubrication trap 50 through the apertures 48 of the jacket at a substantially controlled flow rate only when the projectile is fired through the bore of a firearm barrel. The said flow rate is predetermined according to the size of the apertures 48 of the projectiles jacket 46 and the degree of viscosity of the lubricant in the lubricant trap 50 relative to the intended initial velocity of the said projectile when propelled through the bore, as hereafter described in detail.

The assembled projectile of FIG. 8 is conventially further assembled into the neck 52 of the cartridge powder case 53. The rim 54 of the neck 52 of said cartridge powder case 53 (as shown in FIG. 1) is crimped onto the projectile to the rear of the jacket apertures 48. When the cartridge is initially fired from the breech 13, the lubricant stored in the lubricant trap 50 being a liquid and actually only a partially restrained free part of the projectile, and which is not first directly effected by the propellant gas, the lubricant tends to therefore resist by its standing fluid inertia the initial forward movement gained by the projectile in the firearm barrel by flowing rearward along the sloped wall 72 of the lubrication trap 50 of the projectile's core 49 in which it is contained temporarily and partially confined by the jacket 46 and out through the jacket lubrication apertures 48 and onto the rear cylindric surface of the projectile calibre proper. However before the lubricant has time to flow rearward far enough to effectively lubricate the projectile and bore, the projectile will have moved a short distance forward from the breech with a surface which is not fully lubricated. The gilding metal of the projectiles surface which is not yet fully lubricated will not deposit gilding metal on the bores surface for this short distance as frictional forces have not had sufficient time to build up enough heat to soften the gilding metal to the point of sloughing off onto the bore wall. After the small initial dry movement of the projectile from the breech 13, the lubricant will have coated the projectile's surface to cut frictional forces and subsequent heat in the remainder of the bore.

The jacket lubrication apertures 48 are positioned directly forward of the point where the cylindric calibre proper merges with the rearward end of the projectile ogive and at such a position where said lubrication apertures 48 do not quite touch the bore walls and thereat do not become clogged by any elements present on the said bore walls, in order that a minutely small weep of lubricant may form constantly thereat, whereby the bore walls in close proximity of the weep will brush it over the entire surface of the projectile; the said lubricant weep is seen to be more effectively spread over the projectile's surface when forming within a bore gas-relief chamber, where the lubricant weep hits the forward sloping wall 44, 45 of the bores gas-relief chambers of either embodiment of the firearm barrels. The sloping wall 44, 45 of the said gas-relief chambers will tend to wedge the lubricant weep towards the projectile's surface. The forward twisting movement of the said projectile resisting the said movement of the lubricant weep towards its surface will therefore cause the weep of lubricant to spread over a wide area of the projectile's surface at the forward edge junction of the gas-relief chambers and bore walls 55, 56. It is not essential that the lubricant be spread further in this manner within the gas-relief chambers, as the brushing of the lubricant weep rearward simply by its close proximity to the bore walls proper is sufficient; the gas-relief chambers forward junctions 55, 56 spreading the lubricant somewhat more efficiently is only pointed out to help determine exactly the flow rate and total amount of lubricant which may be required in the lubricant trap 50 in order to fully lubricate the bore surface proper.

It is further pointed out here that a rear cylindric surface area of the calibre proper of the helicoid projectile is ordinarily subjected to hot propellant gases. The point of actual said gas exposure on the projectiles cylindric surface is in an area relative to the size of a bore annular groove 10 or pocket 25 opening measured longitudinally directly ahead of the forward edges of the helical notches in the projectiles; the said point of gas exposure in this rear occuring intermittently as the projectile passes through a succession of said annular grooves 10 or pocket 25 openings of the bore. The said exposed gas area of the projectile may normally have its surface lubricant film partially vaporized by the said hot propellant gases, this area is however instantly and positively relubricated each time the projectile passes through a projectile sized bore area 12, 26 of the barrel directly ahead of the bore annular grooves 10 or pockets 25 opening, by lubricant which is constantly brushed over the projectile's surface by the bore walls as previously described and ensures sealing of the propellant gases within the helical notches and to the rear area of the projectile, ensuring that the relatively low pressure and heat of an annular groove 10 or pocket 25 is maintained against the high heat and pressure of propellant gas in order that the said high heat and pressure of propellant gas contained at the said helicals of the projectiles can be precisely and effectively released into each succeeding annular groove or pocket of the bore.

constructed or formed and shaped in any desired manner for its intended use in the bore or at the target by a particular firearm barrel of this invention, but in any adaptation which may be made, the essential features to be retained are the notches in the rearward end of the projectile formed to partake of a helical curve rising and ending forwardly at the cylindric calibre proper of the projectile a distance from its cylindric calibre forward end.

It will be apparent that the changes and variations as suggested herein, and other modifications might be made in the form and arrangement of parts without departing from the spirit and scope of my invention.

I claim:

1. A firearm projectile, comprising, a cylindric forward area, and a helicoidal rearward area in the form of a series of helical notches constructed and arranged to completely surround said rearward area, all of said helical notches structure arranged to begin immediately from the adjacent demarcation point of a laterally disposed one of the other of said notches construction.

2. A firearm projectile, comprising, means of construction and arrangement of a forward area of a calibre proper for sealing propellant gases within the confines of a firearm barrel's bore, and means of construction and arrangement of a helicoidal rearward area of the said projectile for turning propellant gases traveling along said rearward helicoidally constructed area to impart a twist to the said projectile with the turned said gases staying before, during, and after unvented to the free outside atmosphere.

3. A firearm projectile, comprising, means of construction and arrangement of a helicoidal rearward area of low relative air pressure to effect increased rotative aerodynamic drag in free flight substantially tangentially opposed to the circle of rotation of the projectile below the speed of sound, and means of construction and arrangement of a high air pressure lateral wall adjacent to the helicoidal side which rotatively impinges on the transitional flow of the airstream causing aerodynamic drag in cooperation with the said helicoid side.

4. A firearm projectile comprising, in combination means on the projectile for transitionally actuating expansive impulse flow of propellant gases along its rearward area, and means on the projectile responsive to the foregoing means for imparting, from the impulse flow of propellant gases, a rotational motion to the projectile's forward movement, and obturating means on the projectile for preventing escape of all significant expansion of any part of the column of propellant gases to the free outside atmosphere.

5. A firearm projectile comprising, in combination means on the projectile for transitionally actuating intermittent transitory impulse flows of propellant gases expansively along its rearward area, and means on the projectile responsive to the foregoing means for imparting, from the impulse flow of propellant gases, a rotational motion to the projectile's forward movement, and obturating means on the projectile for preventing escape of all significant expansion of any part of the column of propellant gases to the free outside atmosphere.

6. A firearm projectile comprising, in combination means on the projectile for transitionally actuating intermittent transitory impulse flows of propellant gases expansively along its rearward area, whereby, a series of helicoidally notched areas constructed and arranged to completely surround the rearward area of the projectile are responsive to the foregoing means for imparting rotational movement to the projectile's forward motion, and obturating means on the projectile for preventing escape of all significant expansion of any part of the column of propellant gases to the free outside atmosphere.

7. A firearm projectile comprising, in combination means on the projectile for transitionally actuating intermittent transitory impulse flow of propellant gases expansively along its rearward area, whereby, a series of helicoidally notched areas constructed and arranged to completely surround the rearward area of the projectile are responsive to the foregoing means for imparting rotational movement to the projectile's forward motion, and obturating means on the projectile for preventing escape of all significant expansion of any part of the column of propellant gases to the free outside atmosphere, and, means of construction and arrangement of the projectile's structure functioning, in free flight, to cause increased aerodynamic rotative drag significantly opposed to the circle of rotation of the projectile, in the free atmosphere, below the speed of sound.

8. A method of imparting a rotational motion to a projectile in a firearm barrel by flow of propellant gases within the surface of a rear area of the projectile and increasing its forward velocity when fired along the bore in which the projectile acts as an obturator, wherein propellant gases under static pressure in the bore and acting on the rear area of the projectile are subjected to a partial sudden limited relief of static pressure, into a relatively low pressure and temperature captive environment of a pressure relieving expansion chamber opening into the bore wall forwardly of the point of maximum propellant gas pressure, at the instant when the bearing surface of the projectile has initially passed the chamber opening in the bore wall, whereupon the transiently accelerated bore gases are turned by the projectile to which said bore gases give up some of their momentum absorbed from the column of high pressure gases in the bore to thereby effect rotation of the projectile and increases its forwarded velocity, the gases in said captive environment thereafter turbulently receding rearwardly of the projectile to become a part again of the column of gases in the bore and the residual energy of the gases in said captive environment not absorbed by the projectile or barrel becoming a part of the total energy in the column of gases in the bore, the method including the steps of repeating said partial sudden limited relief of column static pressure into subsequent expansion chambers to thereby recycle said residual energy which, together with the energy in the column of gases, causes transitory increases in projectile rotation and forwarded velocity by converting more of the static pressure of the gases in the column into dynamic pressure at the projectile which thereby absorbs and stores kinetic energy from the column of gases while in the barrel for free flight purposes, and the Thereby a precision twist is imparted to the projectile by safe-guarding the low pressure and heat of the bore gas-relief chambers.

It is seen therefore that the original precision cut of the bore proper must be maintained to ensure that no gas leakage occurs past the projectile other than the points in the bore and on the projectile intended for the passage of propellant gas. Therefore it is noted that because of the very low frictional forces present in the firearm barrels of FIGS. 1 and 3 and the relatively low gas pressure which can be used to propel the helicoid projectile at normal desired velocities, that wear from gas erosion and friction is substantially reduced and the original precision cut of the bore to calibre size is maintained over a much longer period of time than is possible with known rifled firearm barrels propelling projectiles at comparable velocities at much higher gas pressures.

The helical notches are so placed on the projectiles to either be positioned away from the air stream that passes by the projectiles while in free flight, or so positioned on the said projectiles where the air stream becomes rarefied in or over the said helical notches. The said positions of helical notches on the projectiles are desired so that they are not aerodynamically inversely effected while in free flight above the speed of sound by the said air stream pressing onto said helical notches; which are originally intended for propellant gas pressure coming from the rear of the projectile and flowing forward to cause the initial twist.

From the aforesaid descriptions of the helical notched taper-heel projectiles, it is further noted that a boat-tail projectile of known design with a smooth conical rearward area, as described is designed not to upset in the bore of a firearm barrel, it is also known that the taper-heel also greatly increases the projectile's long range flight when its velocity decreases below that of the speed of sound. When the said projectile's velocity is above the speed of sound the air stream around its tapered heel is rarefied and although this reduces air friction in this area, it in itself does not cause the increased range to any appreciable degree, in that the rarefied air causes a large area of high vacuum to remain at the rear of the projectile. However when the projectile's velocity is reduced to the speed of sound and below, the air stream collapses onto the projectile's taper-heel decreasing the size or area of the vacuum, and increasing its range.

This effect of the air stream is taken and put to further useful work with the fully helically notched tapered heel of the projectile of FIG. 8, as hereafter described:

As aforesaid, the rarefaction of the air at the tapered heel of the projectile does little to increase its overall range due to the high vacuum formed, however this said rarefaction of the air is an especially wanted effect, whereby otherwise the fully helically notched tapered heel of the projectile would have substantial rotational aerodynamic drag at intermediate ranges. However it is known that most minor calibre firearm projectiles (and even large calibre ordnance) have an excessively high spin rate at long range and thereat tend to become overly stabilized where the transitional velocity of the projectile is much decreased relative to its rotational velocity and at these ranges an overspin would be imparted to the projectile that would prevent its point from following the trajectory curve. The center of gravity of the projectile would follow the trajectory curve but the projectile would tend to maintain its longitudinal axis parallel to the angle of departure from the muzzle of the barrel. This gyroscopic overstabilization of the projectile causes the projectile to be slowed down rapidly by presenting more and more of its side to the resistance of the air at long range, where the trajectory curve is the greatest and this, in turn, tends to increase the magnitude of oscillation and gyration of the projectile, whereby it becomes unstable in flight and is the cause of much inaccuracy at these long ranges.

The collapse of the air stream, as previously described, pressuring onto the smooth conical of the tapered rearward end area of a known taper-heel projectile has little effect on reducing this excessive rotation of the projectile at long range, but this same effect of the air stream pressuring onto the fully helically notched tapered heel of the projectile of FIG. 8, causes a relatively high amount of beneficial aerodynamic drag and slows down or absorbs some of this said excessive rotation of the projectile at these long ranges, allowing its longitudinal axis (and/or ogive point) to more closely follow the trajectory of its fall and thereby gain in accuracy and even more potential range due to less deflection and resistance by the air.

More specifically this said rotative aerodynamical drag in the notches of the tapered heel of the projectile is caused in part by aerodynamic lift at the side of the notches which partake of the helicoid form, the said aerodynamic lift is tangentially opposed to the circle of rotation of the said projectile at radius points locted at the helicoid areas of said notches, said tangentially aerodynamic lift is caused by the rotation of the projectiles helically notched tapered heel against the transitional flow of the air-stream, said transitional flow of the air-stream within the said notches being rarefied at the helicoid side of the notches causing a lifting force to act tangentially on the said helicoid sides, the other area of said rotative aerodynamical drag is caused on the plane wall side of the said notches which rotatively impinge against the transitional flow of the air-stream.

In the present instance I have illustrated the projectile in the form of a helicoid projectile and have described and shown the interior and exterior ballistic characteristics.

The projectile might be fitted in the shaped neck 52, in the outer end of a powder case 53, or might be fitted in at the breech of a particular firearm barrel of this invention without the use of a powder case, whereat it may be fired by a charge of explosive either placed in the gun after the projectile has been placed in the breech, or the propellant may be attached in pellet form directly to the rearward end of the projectile itself, using any known priming means for firing the charges, and in any instance the burst of the gas expansion due to the explosion of the charge will be permitted to act directly upon the helically notched shaped rearward end of the projectile.

In the use of the projectile either with a cartridge powder case or without the employment of the case, the firing of the explosive charge will cause a twist to be imparted to the helically notched projectile cooperating with gas-relief chambers in the bore of a firearm barrel.

As has been stated, it is of course apparent that if the projectile just described is to be fired at known high velocities and is accurately sized to the bore, the gliding metal presently used on projectiles will suffice as a dry lubricant on the surface of the projectile and the fluid lubricating means described may be omitted, whereby the interior and/or exterior of the projectiles may be method including the steps when the projectile in free flight below the speed of sound, atmospheric air flow within the surface of the rear area of the projectile increases and the rear area then functions to increase aerodynamic drag tangentially opposed to the circle of rotation of the projectile significantly coordinated with its decreasing forward velocity to thereby reduce the effect of gyroscopic spin overstabilizing forces acting along the projectile's longitudinal axis whereby the angle of attack of the projectile, when traveling a long distance through the atmosphere, is significantly controlled in coordination with the curve of the projectile's trajectory to thereby provide increased range and greater accuracy to the target.

* * * * *

UNITED STATES PATENT AND TRADEMARK OFFICE

CERTIFICATE OF CORRECTION

PATENT NO. : 4,379,531

DATED : May 31, 1983

INVENTOR(S) : John R. Manis

It is certified that error appears in the above-identified patent and that said Letters Patent is hereby corrected as shown below:

Column 10, line 56, "is" should read -- it --.

Column 12, line 59, "relaive" should read -- relative --.

Column 13, line 27, "taper-hell" should read -- taper-heel --.

Column 18, line 32, "therethrough" should read -- there through --.

Column 20, line 49, after "rear" insert -- area --.

Column 22, line 64, "gliding" should read -- gilding --.

Signed and Sealed this

*Fourth* Day of *December 1984*

[SEAL]

*Attest:*

GERALD J. MOSSINGHOFF

*Attesting Officer* *Commissioner of Patents and Trademarks*